United States Patent [19]

Knowles

[11] Patent Number: 4,769,957

[45] Date of Patent: Sep. 13, 1988

[54] NEEDLE AND LEAF DRAIN GUTTER GUARD

[76] Inventor: Wilma B. Knowles, 204 Farmington Rd., Virginia Beach, Va. 23454

[21] Appl. No.: 103,951

[22] Filed: Oct. 2, 1987

[51] Int. Cl.[4] ..... E04D 13/00

[52] U.S. Cl. ..... 52/12; 210/247; 210/474

[58] Field of Search ..... 52/12; 210/247, 474, 210/469

[56] References Cited

U.S. PATENT DOCUMENTS

| | | | |
|---|---|---|---|
| 1,308,311 | 7/1919 | Ward | 52/12 |
| 3,295,264 | 1/1967 | Olson | 52/12 |
| 4,644,704 | 2/1987 | Pedzonay | 52/12 |

*Primary Examiner*—Henry E. Raduazo

[57] ABSTRACT

A structure to prevent all manner of debris from entering into and clogging the drain guttering system of a sloping roof dwelling or building; through the use of a fine mesh screening top immediately underlying which is located a gently sloping needle stop permitting only the tiniest grip for any needle which may pierce the screening, assuring that it shall topple over and be blown away with a change in climatic conditions and wind direction. This solid surface gently sloping needle stop leads the rain water to a series of drainage holes beneath the ledge of a needle deflector (preventing needles from reaching the drainage holes) and into the main guttering system through which it flows to and down the downspout.

3 Claims, 2 Drawing Sheets

NEEDLE AND LEAF DRAIN GUTTER GUARD

FIELD OF THE INVENTION

This invention relates generally to a means of preventing debris, particularly leaves and pine or fir needles, from entering into and clogging roof drain gutters and downspouts.

BACKGROUND OF THE INVENTION

Because clogged gutters and downspouts can cause rain water to over-flow the gutter and promote damage to buildings and foundations, and, in fact, defeat the very purpose of installing gutters in the first place, there have been any number of attempts to prevent the entry of debris into the guttering system. Most common of these attempts is the installation of a screen, wire mesh or expanded metal or plastic mesh over the top of the gutter; this method, though effective against sizeable leaves and/or twigs, fails miserably in dealing with pine or fir needles. In those geographical areas where pine and fir trees are numerous the needle, itself, in conjunction with screen or mesh become a primary problem; as the needle becomes ensnared in the screen or mesh cover it, in turn, becomes a trap for more needles and leaves, and, ultimately, builds into a dam of its own and prevents rain water from entering into the drain gutters.

Other methods have been proposed, particularly U.S. Pat. Nos. 4,616,450; 4,604,837; 4,455,791; and 4,435,925 which, essentially, provide a solid cover for the gutter and depend upon the surface tension of the rain water to follow the contour of the cover around an edge and into some sort of opening into the gutter. These methods may be effective in preventing the entry of debris into the system but would only handle moderate water flow, in major rain storms the water quantity and velocity would tend to over-flow the gutter guard, again defeating the original purpose of installing the gutters in the first place.

U.S. Pat. No. 4,418,504 covers a solid type of guard with uniquely designed "reverse" water flow entry holes in the top of the guard. Though much thought must have gone into this and conceding the fact that it would probably be effective in preventing most debris entry into the system, it, too, would have the same limitations as to the amount of rain water that it would handle; it may be effective in minor rain storms but would be woefully inadequate in handling the quantity and velocity of rain water in a major storm.

SUMMARY OF THE INVENTION

The main purpose of the invention is to provide a reliable means of keeping all manner of debris from entering the gutters, at the same time freely permitting the flow of substantial amounts of high velocity rainwater into the guttering system which may be encountered in a major rain storm. To meet this objective we intend to completely cover the top of the gutter with a structure that consists of:

a fine mesh screen covering approximately one half to three fifths of the rear of the gutter, to eliminate all but the finest of debris (such as the sharp end of pine or fir needles).

immediately underlying this fine mesh screen there is located a gently sloping solid surface needle stop which will prevent any needles which do, in fact, pierce the fine mesh screen from gaining anything near a meaningful purchase; such needles, due to their very slight ensnarement, will more than likely be blown away as they become dry and/or the wind direction changes (the slight obstruction of the screen material does not impede the entry of major quantities of high velocity rain water).

this gently sloping needle stop leads to a series of drainage holes located at the front mounting edge and water diverter section of the needle and leaf drain gutter guard structure.

immediately above the drainage holes is located a solid surface needle deflector which joins with the fine mesh screen at a point approximately one half inch to the rear edge of the drainage holes, this deflector prevents any needles which may have pierced the screening in that area from reaching the drainage holes and gaining a more meaningful purchase.

BRIEF DESCRIPTION OF THE DRAWING

The above summary will become much more apparent upon reviewing the following description, including the drawings in which like parts are referred to with like identification numerals, and wherein.

DETAILED DESCRIPTION

Figure 1:
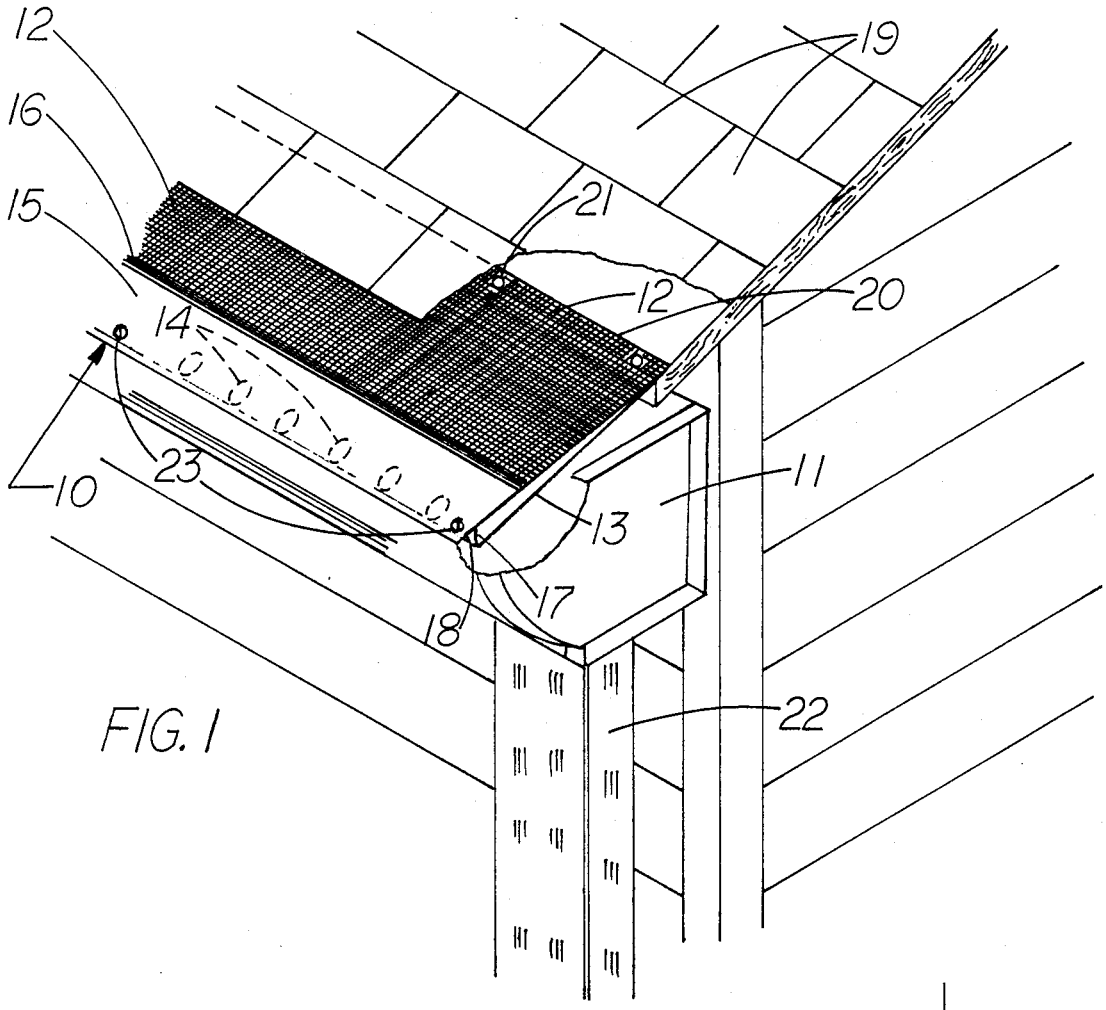
FIG. 1 is a perspective view of the needle and leaf gutter guard installed on a typical drain gutter.
Figure 2:
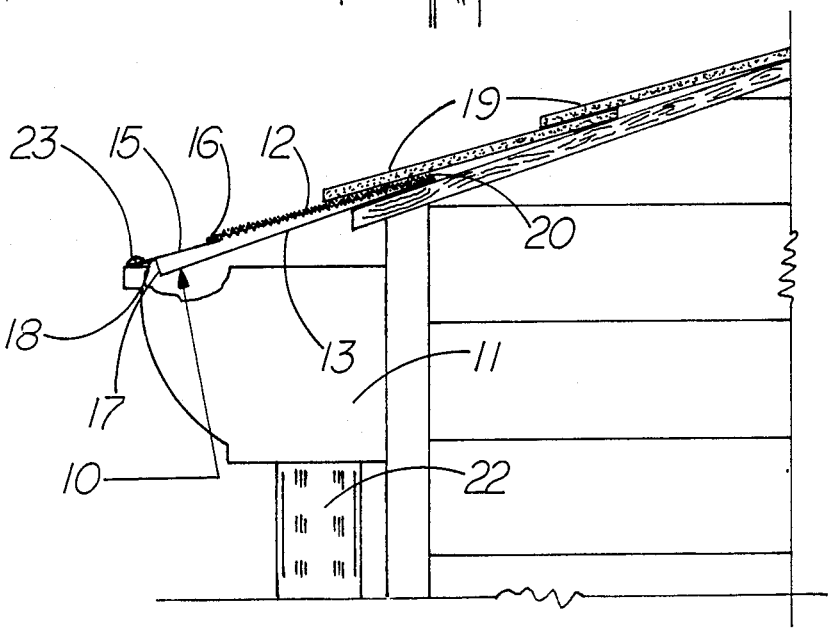
FIG. 2 is a side view of the gutter guard shown installed on a typical drain gutter.
Figure 3:
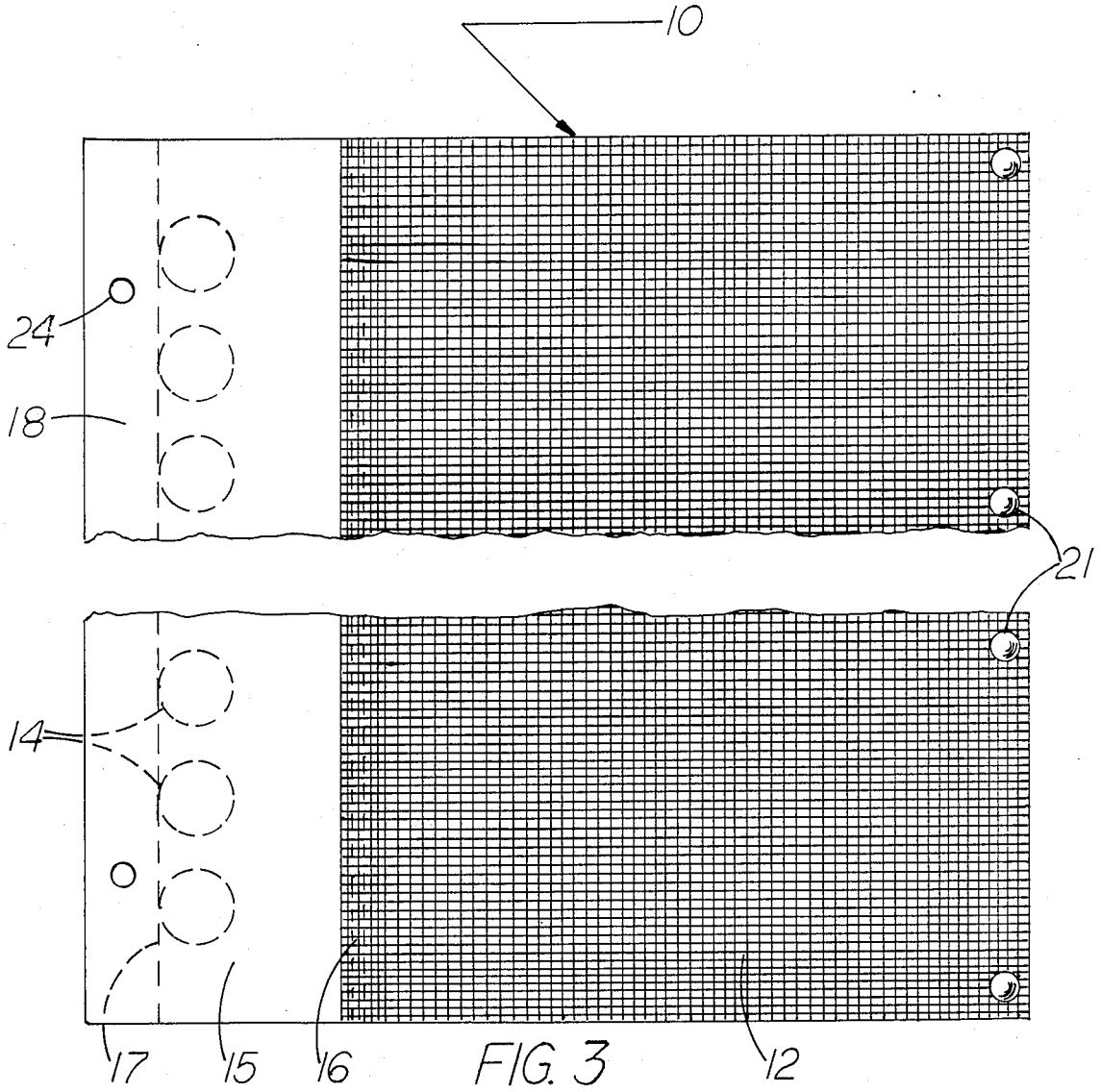
FIG. 3 is a plan view of the needle and leaf drain gutter guard.
Figure 4:
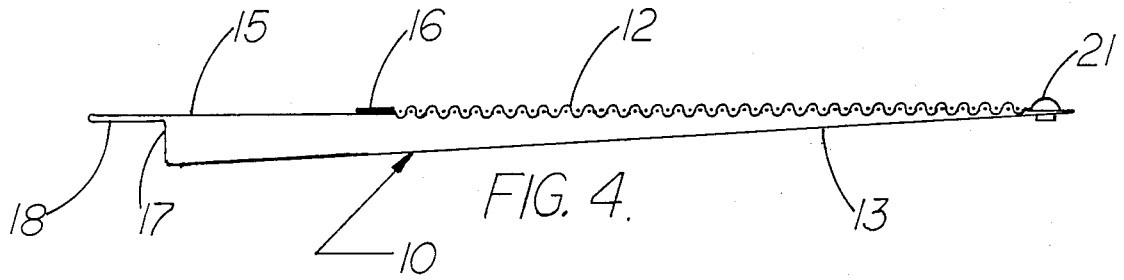
FIG. 4 is a side view of the needle and leaf drain gutter guard.

Embodiment 10 of the invention, the needle and leaf drain gutter guard assembly, is shown installed over a typical drain gutter section 11 in FIGS. 1 and 2; and separately in FIGS. 3 and 4. As indicated in FIGS. 1 and 2 the gutter guard assembly 10 mounts over the gutter 11 and is held in place at the front by the conjunction of the front mounting edge 17 and the front support 18, and the installation of a suitable fastener 23 (which could be a pop rivet or sheet metal screw which, if used, would utilize the mounting holes 24 provided in the front mounting support 18). Retention at the rear 20 is effected by installing the rear of the structure beneath the leading edge of shingles 19.

In actual function the leading edge of the overlying shingles 19 directs the rain water to the fine mesh screen 12 whereat the water tends to percolate through the screening to the underlying needle stop 13, which, in turn, directs the water to a series of drainage holes 14 which are located at the front of the needle stop 13 and closely adjacent to the front mounting edge and water diverter 17. This water then enters nearly debris free, into the gutter 11 and ultimately flows to and down the downspout 22.

Immediately above and covering the drainage holes 14 there is located a needle deflector 15 which is of a solid surface to prevent any needles from reaching the aforementioned drainage holes 14 and gaining a meaningful purchase and possibly promoting a potential future problem.

The needle deflector 15 meets with and is joined to the fine mesh screen 12 at a point approximately one half inch to the rear of the drainage holes 14 by means of crimping or bonding the screen to the main structure at 16 (crimping or bonding would be dictated by the manufacturing method and/or material selected to produce the primary structure—which could be a roll formed section of aluminum or galvanized sheet metal, or, if so desired, an extruded section of either aluminum or plastic. A roll formed section of aluminum would appear to be the preferred manufacturing method).

The screening 12 would be joined to the needle stop 13 at the rear of the main structure by means of a rivet or eyelet 21 to add a degree of rigidity to the screening 12 and prevent it from completely collapsing upon the needle stop 13.

In summary, then, as to the needle and leaf drain gutter guard 10, I have invented a structure to cover the entire top of the gutter from beneath the leading edge of the shingles to the front edge of the gutter. Rain water entering into the guttering system must flow through a fine mesh screen which will keep all but the finest of debris from gaining entry. It is visualized that the only such debris (other than fine dirt or sand which would simply wash through the system) would be the very tips of pine or fir needles; these needles would be denied entry into the system by the location of a needle stop immediately below the screen to prevent them from obtaining a substantial grasp in the screening material, and making them very subject to being blown away as they dry and/or wind direction changes. Rain water will pass through the screening nearly unimpeded by any retained debris and through a series of drain holes into the drain gutter and down the downspout.

I claim:

1. A needle and leaf drain gutter guard for use on a drain gutter having a top front and top rear surface said guard having a first and second parts, said first part comprising a screen mesh adapted to cover the top rear surface of said drain gutter, and a front portion comprising a solid surface; and said second part comprising a needle stop portion of solid material adapted for positioning beneath said screen mesh of said first part and a perforate portion for positioning beneath said solid surface of said first part whereby needles penetrating said mesh will be stopped by said needle stop and thus be easily removable, but, water will pass through said mesh and run across said needle stop to the perforate portion of the second part where it may pass through the perforations of said second part to said gutter.

2. A gutter guard of claim 1 wherein the mesh is adapted to cover one half to two thirds of said gutter top surface.

3. A gutter guard as in claim 1 wherein the first and second parts have a mounting means for accepting standard fasteners.

* * * * *